United States Patent [19]

Grebner

[11] 4,096,368

[45] Jun. 20, 1978

[54] PUSHBUTTON SWITCH

[75] Inventor: Stuart W. Grebner, Cleveland, Ohio

[73] Assignee: Cutler-Hammer, Inc., Milwaukee, Wis.

[21] Appl. No.: 703,572

[22] Filed: Jul. 8, 1976

[51] Int. Cl.[2] ..... H01H 9/16; H01H 13/60

[52] U.S. Cl. ..... 200/314; 200/16 B; 200/153 J; 200/153 M; 200/159 A

[58] Field of Search ..... 200/16 B, 153 J, 153 M, 200/159 A, 314, 243, 280, 281, 295

[56] References Cited

U.S. PATENT DOCUMENTS

| | | | |
|---|---|---|---|
| 1,169,099 | 1/1916 | Wilcox et al. | 200/153 M |
| 2,814,680 | 11/1957 | Sherrick | 200/16 B |
| 2,956,446 | 10/1960 | Ensign, Jr. et al. | 200/314 X |
| 3,188,437 | 6/1965 | Lauren | 200/314 X |
| 3,542,988 | 11/1970 | Baldasare | 200/153 J X |
| 3,701,870 | 10/1972 | Sorenson | 200/295 |

*Primary Examiner*—J. V. Truhe
*Assistant Examiner*—David A. Tone
*Attorney, Agent, or Firm*—Hugh R. Rather; William A. Autio; Michael E. Taken

[57] ABSTRACT

A small light duty multi-pole pushbutton switch is disclosed having a plurality of notched contact pins carried by respective legs of a linearly reciprocal pushbutton actuator for wiping bridging engagement with respective pairs of spaced stationary leaf spring contacts. The actuator is telescopically received in one end of a housing for longitudinal movement therein with the legs extending longitudinally thereinto. The leaf spring contacts are mounted by circuit modules at the other end of the housing and extend longitudinally thereinto. In preferred form, the switch may be front of panel mounted in a ¾ inch square panel hole. The switch may be illuminated and may provide alternate or momentary action.

17 Claims, 9 Drawing Figures

Fig. 1
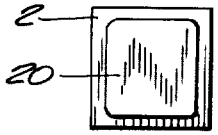
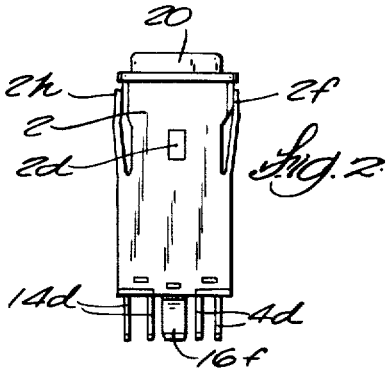
Fig. 2
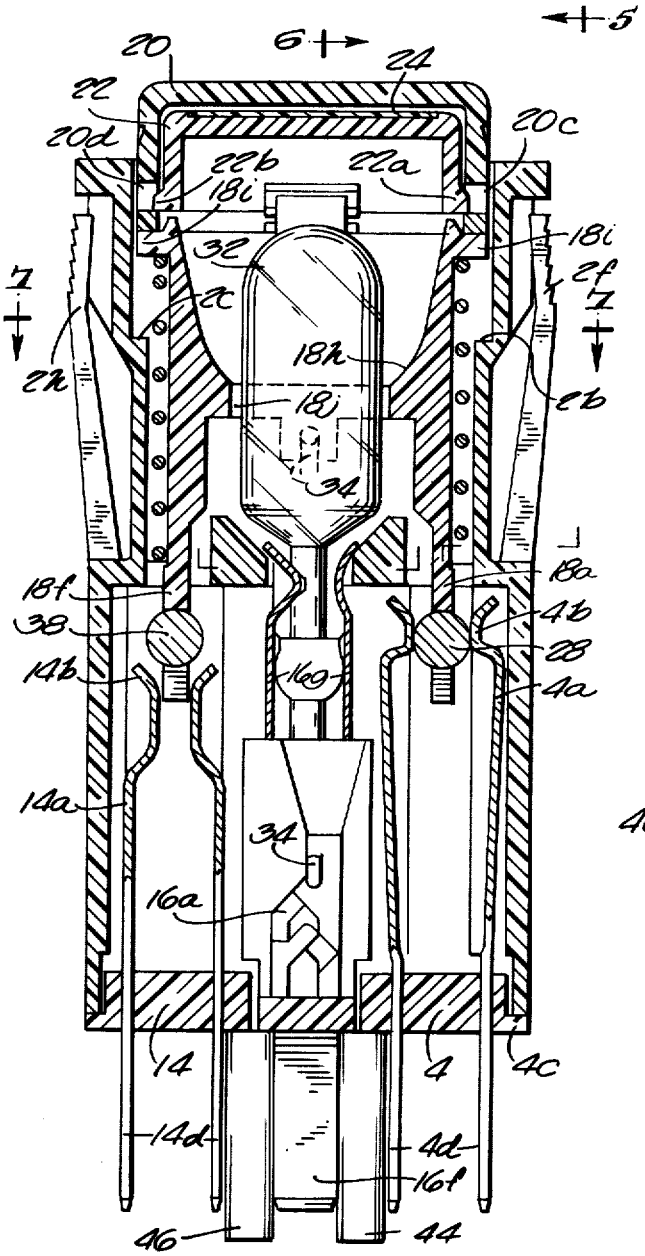
Fig. 4
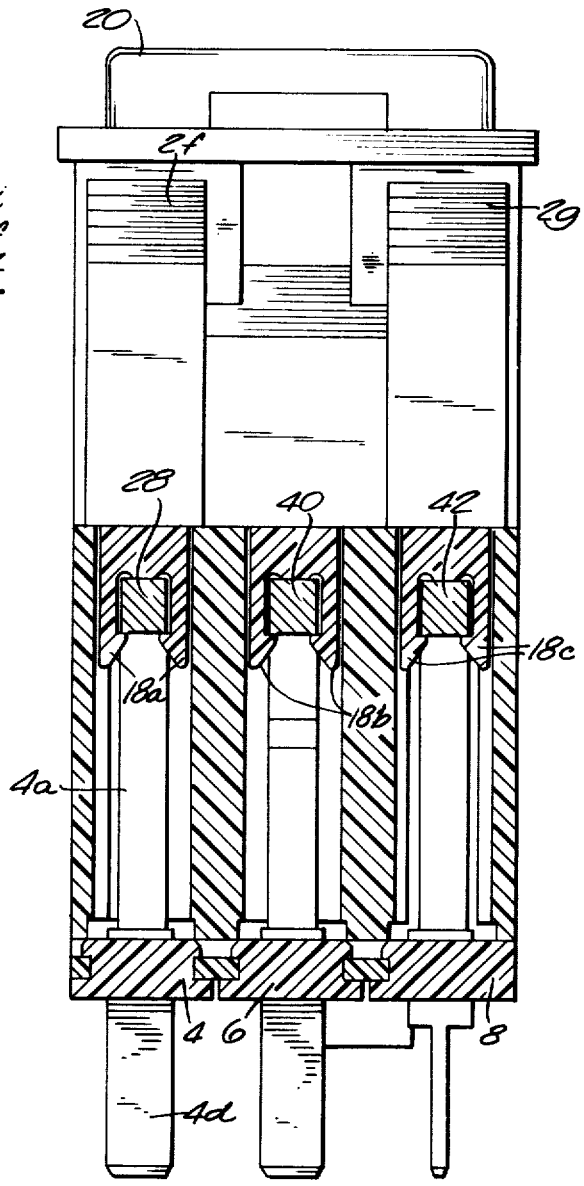
Fig. 5

Fig. 6
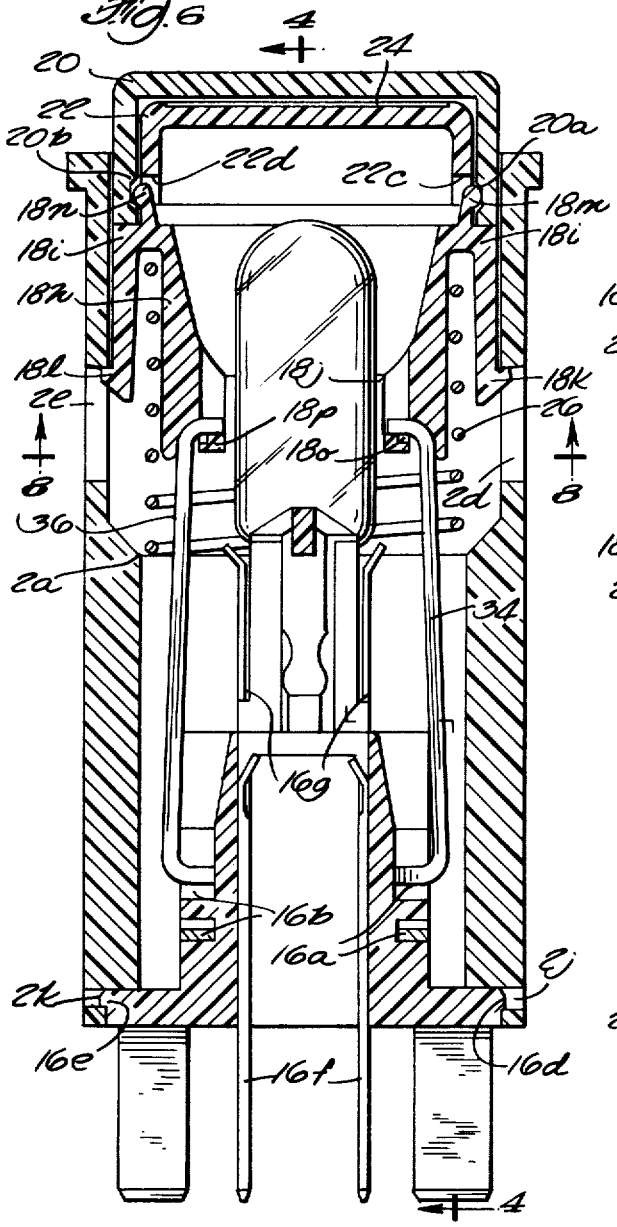
Fig. 7
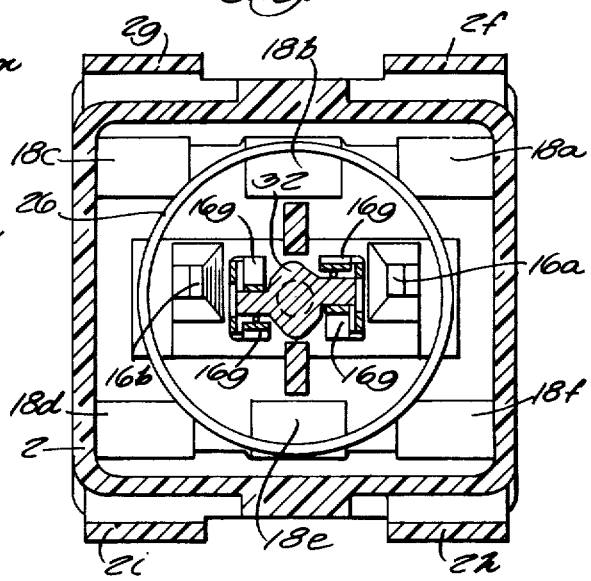
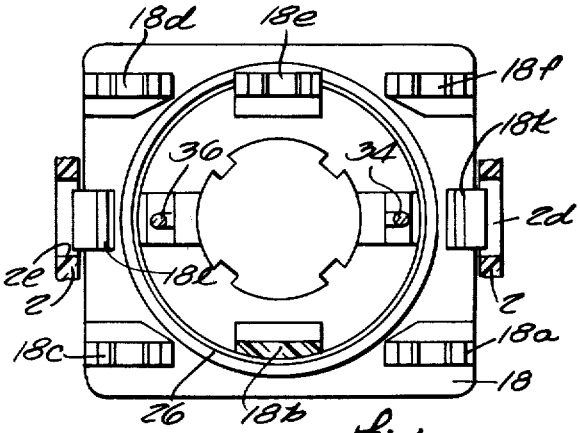
Fig. 8
Fig. 9
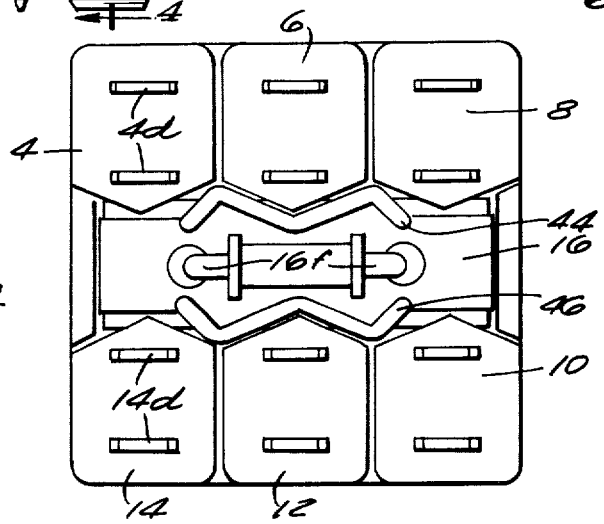

PUSHBUTTON SWITCH

BACKGROUND OF THE INVENTION

Prior pushbutton switches of compact size, such as 1-5 amp light duty types, have been known heretofore. However, these prior switches have been subject to one or more disadvantages such as: a limited number of poles; no illumination; high cost; complexity of design and numerous parts; only normally closed or only normally open; unevenly lighted display; restricted display flexibility; special tools for relamping; restricted access for relamping; restricted circuit flexibility; restricted termination flexibility; momentary action only; non-wiping contact engagement; inability to meet both domestic and foreign standards; non-tactile feedback; non-audible feedback; non-adaptability to printed circuit board termination; canting of the pushbutton in a held-down alternate action position; numerous and intricate assembly steps; and limited application.

The present invention overcomes these and other disadvantages.

SUMMARY OF THE INVENTION

An object of the invention is to provide an improved pushbutton switch.

Another object is to provide an improved multipole compact pushbutton switch.

Another object is to provide a multipole push button switch affording wiping contact engagement in a compact structure.

Another object is to provide a pushbutton switch having a maximum number of poles in a minimum amount of space.

Another object is to provide a pushbutton switch capable of snap-in front of panel mounting.

Another object is to provide a low cost compact multipole pushbutton switch which has a minimum number of parts and is easy and economical to manufacture and assemble.

Another object is to provide a pushbutton switch affording snap-in assembly.

Another object is to provide an illuminated compact pushbutton switch having a wide range of display flexibility.

Another object is to provide a compact pushbutton switch having an evenly lighted display.

Another object is to provide a pushbutton switch affording front of panel relamping without the necessity of any special tools.

Another object is to provide a pushbutton switch having interchangeable film legend inserts.

Another object is to provide a pushbutton switch having interchangeable color filters.

Another object is to provide a pushbutton switch affording a split display.

Another object is to provide a pushbutton switch affording a wide range of circuit flexibility.

Another object is to provide a pushbutton switch having a plurality of poles which are normally closed or normally open or any combination thereof.

Another object is to provide a pushbutton switch having plug-in circuit modules.

Another object is to provide a pushbutton switch affording a wide range of termination flexibility.

Another object is to provide a pushbutton switch affording printed circuit board termination.

Another object is to provide a compact multipole pushbutton switch complying with both domestic and foreign standards.

Another object is to provide a pushbutton switch affording momentary or alternate action.

Another object is to provide an alternate action pushbutton switch which is retained in a level, uncanted helddown position.

Another object is to provide a momentary action pushbutton switch affording tactile and/or audible feedback.

A more specific object is to provide a preferred embodiment of a pushbutton switch incorporating the above mentioned objects and which has up to six poles and is mountable in a 3/4 inch square panel hole.

Other objects and advantages will hereinafter appear.

BRIEF DESCRIPTION OF THE DRAWINGS

FIG. 1 is a front elevation view of the preferred embodiment of the present invention drawn to actual scale to show the actual size of the pushbutton switch.

FIG. 2 is a side elevation view drawn to actual scale.

FIG. 14 is an enlarged cross-sectional view of the switch of FIG. 3 taken along line 4—4 of FIG. 6.

FIG. 5 is a view partly in elevation and partly in cross-section taken along line 5—5 of FIG. 4.

FIG. 6 is a cross-sectional view taken along line 6—6 of FIG. 4.

FIG. 7 is a cross-sectional view taken along line 7—7 of FIG. 4.

FIG. 8 is a cross-sectional view taken along line 8—8 of FIG. 6.

FIG. 9 is an end view of the switch of FIG. 4.

DESCRIPTION OF THE PREFERRED EMBODIMENT

Figure 3:
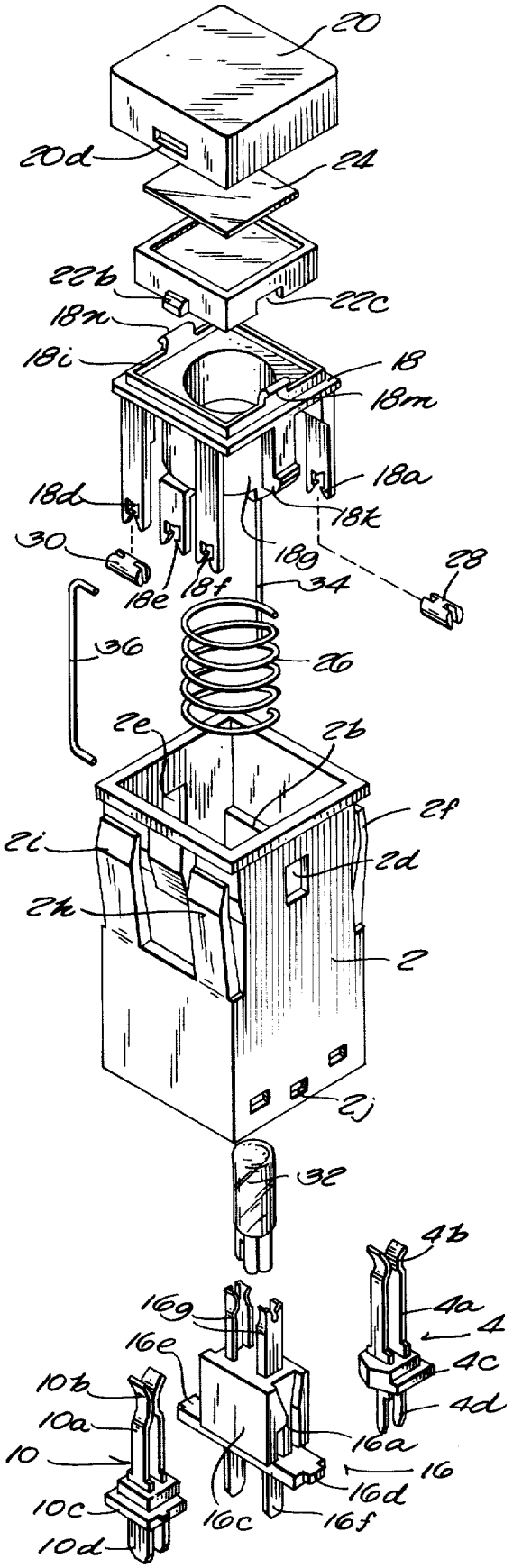
FIG. 3 is an exploded isometric view of the pushbutton switch.

There is shown in FIGS. 1 and 2 front and side elevation views of a light duty 1-5 amp pushbutton switch constructed in accordance with the invention. FIGS. 1 and 2 show the actual size of the switch, whereby the clearly illustrate its compactness. Such a switch is mountable in a square panel hole, ¾ of an inch on a side.

FIG. 3 shows an exploded isometric view of the push button switch. A square elongated housing is open at each end for receiving circuit modules and a lamp base at the bottom end and for telescopically receiving operator means at the top end. Up to six circuit modules 4, 6, 8, 10, 12 and 14, FIG. 9, and a lamp base 16 are snap-fittingly mounted to the bottom of the housing. The operator means comprises an insulating actuator 18 and a button cap 20 and may include a color filter 22 and a film legend insert 24, all snap-fittingly attached. A helical compression spring 26 acts as a return spring to bias the actuator outwardly of the housing. The actuator has six insulating legs 18*a*, 18*b*, 18*c*, 18*d*, 18*e* and 18*f*, FIG. 8, extending longitudinally into the housing and each leg has a bifurcated end to which a notched cylindrical contact member or pin, such as 28, FIG. 3, may be snap-fittingly mounted. As the operator is depressed inwardly of the housing contact pin 30, for example, slidingly bridges the spaced stationary leaf spring terminals 10*a* of circuit modules 10 by sliding between and engaging the inwardly bent portions 10*b* of the terminals to complete a circuit thereacross, this being a normally open switch. An alternate configuration of the terminals, for example, as shown by circuit module 4, may afford a normally closed switch wherein, for example, contact pin 28 normally bridges inwardly bent portions 4b of terminals 4a and breaks contact when the operator is pushed inwardly.

The switch may be illuminated by a lamp 32 mounted to lamp base 16 and extending up through a hollow tubular portion 18g in the actuator and into a parabolic shaped cavity 18h, FIG. 4, to enhance illumination.

The switch may be provided with alternate (push-push) action. Elongated C-shaped alternate action wires 34 and 36 are hooked at one end to actuator 18, FIG. 6, and the other ends ride in alternate action cams 16a and 16b formed in the lamp base by a series of stepped channels.

As disclosed, the switch is a one to six pole switch with each pole having a plug-in circuit module which may have a normally oepn or normally closed configuration. Each module comprises two combination contact and terminal parts continuous strip insert molded into a plastic base whereby to render, using module 4 as an example, a plastic base portion 4c, a pair of plug-in terminal portions 4d, and a pair of spaced stationary leaf spring contacts 4a. Alternate configurations of the terminal portions may be formed, for example 10d, to provide desired termination for circuit board insertion or any other type of mating connection, etc. The contact terminal portions, 4a for example, extend longitudinally into the housing for engagement by respective contact pins. FIG. 4 shows the operator in its outwardly extended position with contact pin 28 statically bridging inwardly bent portions 4b of stationary contact terminals 4a having a normally closed configuration whereby the circuit is broken when the operator pushed inwardly to drive pin 28 out of engagement with portions 4b. FIG. 4 also illustrates a normally open configuration of the stationary contact terminals wherein terminals 14a extending longitudinally into the housing and have inwardly bent portions 14b, comparable to portions 10b in FIG. 3, to be slidingly bridged by contact pin 38 driven therebetween by leg 18f when the operator is pushed in, thereby completing a circuit between the plug-in terminals 14d of circuit module 14.

As shown in FIG. 3, actuator 18 is an integral insulating plastic member. This actuator has a square perimeter upper portion 18i from which extends the tubular portion 18g having the upwardly opening parabolic cavity 18h, FIGS. 4 and 6, and a central aperture 18j extending longitudinally downwardly from the cavity through the tubular portion for receiving lamp 32. Extending from opposed bottom edges of the tubular portion are middle legs 18e and 18b, and extending from corners of upper perimeter portion 18i are outer legs 18a, 18c, 18d and 18f, FIGS. 3 and 8, to form three parallel legs on each side of the actuator extending longitudinally into the housing. Each leg has a bifurcated notched end complementary to a respective cylindrical notched metal contact pin to mount the latter in snap-in relation. As shown in FIG. 5, contact pins 28, 40 and 42 are rigidly retained and carried by legs 18a, 18b and 18c by being held between the notched bifurcated ends of the legs after being snapped-in therebetween. Longitudinal movement of the actuator thus causes circuit making and/or breaking as shown in FIG. 4 and aforedescribed wherein module 4 depicts a normally closed configuration and module 14 depicts a normally open configuration.

The actuator is biased outwardly by return spring 26. The bottom of this spring bears against a ledge 2a, FIG. 6, of the housing, and the top of the spring bears against the underside of upper perimeter portion 18i of the actuator, as seen in FIGS. 4 and 6. The downward or inward movement is limited by opposed ledges 2b and 2c, FIGS. 3 and 4, formed in the interior of the housing to act as a stop against upper perimeter portion 18i of the actuator. The outward movement of the actuator under the bias of spring 26 is limited by a pair of short tab legs 18k and 18l, FIGS. 3 and 6, extending longitudinally downwardly from opposite sides of perimeter portion 18i, and having laterally extending hooking nibs at the ends thereof protruding through apertures 2d and 2e in respective opposite side walls in the housing for stopping the outward movement of the actuator when the hooking nibs of short tab legs 18k and 18l strike the upper edges of apertures 2d and 2e.

The actuator has a pair of tabs 18m and 18n, FIG. 3, formed on opposed top sides of perimeter portion 18i for retaining button cap 20 in snap-in engagement. As seen in FIG. 6, cap 20 has detent grooves 20a and 20b in opposed interior side walls thereof formed complementarily to tabs 18m and 18n whereby the cap may be snapped onto the actuator. Perimeter portion 18i is shouldered to provide a good fit against the bottom of the side walls of cap 20 as seen in FIGS. 3, 4 and 6. The cap has apertures 20c and 20d, FIGS. 3 and 4, in the other opposed side walls thereof for mounting in snap-in engagement the color filter 22 having tabs 22a and 22b formed on opposed sides thereof to complementarily snap into and be retained by apertures 20c and 20d. The color filter has slots 22c and 22d, FIGS. 3 and 6, formed in the other opposed sides thereof to allow clearance for tabs 18m and 18n to engage grooves 20a and 20b for retaining cap 20. A film legend insert 24 may be mounted between the cap and the color filter. It is thus seen that the button cap is mounted to the actuator, the color filter is mounted to the button cap, and the film legend insert is retained between the latter two mentioned members, thus affording easy front of panel relamping by simply removing the button cap to permit access to the lamp. Many types of caps, filters and legends may be used thus affording desired versatility and display flexibility.

Formed integrally with the housing on opposed exterior side walls thereof are two pairs of resilient mounting brackets 2f, 2g, 2h and 2i, FIGS. 3, 4 and 5. These brackets have serrated edges near the ends thereof and afford front of panel snap-in mounting of the switch.

Combination lamp base and alternate action cam 16 is mounted at the bottom of the housing and comprises a base portion 16c having a pair of lock-in tabs 16d and 16e received in apertures 2j and 2k of the housing to retain the lamp base. Plug-in terminals 16f extend from the base externally of the housing for carrying current to lamp terminals 16g to energize lamp 32.

The switch may be provided with push-push action if desired by incorporation of the alternate action wires 34 and 36, FIG. 3, the upper ends of which are hooked in notches 18o and 18p, FIG. 6, respectively, of the actuator, and the lower ends riding in stepped-channel alternate action cams 16a and 16b, respectively. These cams, comprising a series of ramps and dropoff ledges, are well known in the art and may form, for example, a generally inverted heart-shaped configuration, as shown in FIG. 4, whereby to hold the operator in a depressed position until repushing thereof. The alternate action wires can, of course, be deleted to provide a switch with momentary action.

It is thus seen that the present invention affords an extremely small pushbutton switch. In preferred form, the switch is mountable in a ¾ inch square panel hole and provides one to six poles. Mounting brackets 2f, 2g, 2h and 2i afford snapin front of panel mounting. The disclosed switch structure allows a maximum number of poles in a minimum amount of space due to the contact pin bridge type construction which takes up very little space. This construction further provides desirable wiping action between contact surfaces.

The disclosed structure affords a low cost switch which is economical to manufacture and has a minimum number of parts. A separate subassembly, comprising the actuator, return spring, alternate action wires and notched contact pins, is assembled by: deflecting the middle legs 18b and 18e toward each other; slipping the return spring thereover; allowing the legs to return to their normal position, thus trapping the return spring; snapping the notched contact pins in place in the retainer legs; and hooking the alternate action wires in place. This entire subassembly is then snapped into the housing.

Not only does the switch afford wide circuit flexibility with respect to the number of poles thereof, but also with respect to the normally closed or open condition thereof. Though an extremely small square switch has been disclosed, it can easily be appreciated that one of the side dimensions can be increased to afford a comparably small rectangular switch with, for example, eight poles, four on each side, by merely elongating the side dimension of the housing and adding more legs on the flanks of the actuator; or the overall dimensions of the switch may be increased to afford a desired number of poles and/or increase current carrying capacity. The poles of the switch may be normally open or normally closed or any combination thereof depending on the configuration of the leaf spring contact terminals of the circuit modules.

The switch also affords termination flexibility. The circuit modules may be provided with various types of plug-in terminals, two of which, 4d and 10d, are shown in the drawings. Furthermore, as shown in preferred form, the switch affords printed circuit board termination, if desired; and also complies with domestic and foreign standards by having printed circuit board spacing, 0.05 inch grid pattern, while maintaining 3 mm (0.118 inch) minimum spacing between terminals to meet foreign specifications. As shown in FIGS. 3 and 9, the circuit modules are of angled shape toward the center of the switch and there are two barriers 44 and 46, FIGS. 4 and 9, on either side of the lamp terminals 16f in the center of the switch. These angled barriers and the corresponding shape of the modules, plus their small size, make possible printed circuit board spacing and the 3 mm minimum spacing between terminals, all in a ¾ inch square housing. The 3 mm spacing between the lamp terminals and the nearest circuit terminals is achieved by measuring up and over the barriers, while the circuit terminals achieve the spacing in all other directions by simply being far enough apart on the 0.05 inch grid pattern.

The switch also affords operating action flexibility by providing momentary or alternate action. The two opposed alternate action cams 16a and 16b in the lamp base keep the actuator level in a held down position, not only improving appearance, but also assuring registry of the contact pins with respect to the leaf spring contact terminals by preventing canting of the plane of the contact pins. As can easily be appreciated, many types of cam configurations may be used. One way of changing the cam configuration is to change the inserts in the mold therefor. A different cam configuration may, for example, provide a momentary switch with audible and/or tactile feedback.

The switch also affords display flexibility. The switch may be illuminated or non-illuminated. In the illuminated version, the color filter and/or film legend insert and/or button cap may provide the desired color. The film legend insert allows the user to interchangeably substitute a desired legend for a particular use. One of many variations may be, for example, a split display in a rectangular switch. The actuator has a parabolic reflector, cavity 18h, to provide an evenly lighted display. Furthermore, the switch affords front of panel relamping without needing special tools, by merely snapping off the button cap.

The terms and expressions appearing herein are used for purposes of description, not limitation, and there is no intention in the use of such terms and expressions of excluding any of the features shown, or described, or portions thereof, and it is recognized that various modifications are possible within the scope of the invention claimed.

I claim:

1. An electric switch comprising:

an elongated housing;

an insulating actuator received at one end of said housing for limited linearly reciprocal movement longitudinally therein and having a plurality of legs in lateral peripheral arrangement thereon and extending longitudinally into said housing;

means biasing said actuator outwardly of said housing;

a plurality of movable contact members, each carried by a respective leg; and a plurality of pairs of laterally spaced stationary leaf spring contacts mounted at the other end of said housing in lateral peripheral arrangement and extending longitudinally into said housing, each pair being slidingly bridged by a respective contact member driven therebetween by a respective leg in response to movement of said actuator;

wherein said legs have bifurcated notched inner ends and said contact members comprise complementally notched pins retained by said bifurcated ends of said legs in snap-in relation.

2. The switch according to claim 1 wherein said housing has integral mounting brackets formed thereon to provide front of panel snap-in mounting.

3. The switch according to claim 1 wherein each of said legs is insulating and extends between and electrically isolates a respective pair of stationary contacts when the respective contact member is not bridging said pair.

4. The switch according to claim 1 wherein each of said pairs of stationary contacts comprises one pole of the switch, each pole being either normally open or normally closed, independently of the remaining poles, in accordance with the configuration of its stationary contacts.

5. An electric switch comprising:

an elongated housing;

an insulating actuator received at one end of said housing for limited linearly reciprocal movement longitudinally therein and having a plurality of legs in lateral peripheral arrangement thereon and extending longitudinally into said housing;

means biasing said actuator outwardly of said housing;

a plurality of movable contact members, each carried by a respective leg; and a plurality of pairs of laterally spaced stationary leaf spring contacts mounted at the other end of said housing in lateral peripheral arrangement and extending longitudinally into said housing, each pair being slidingly bridged by a respective contact member driven therebetween by a respective leg in response to movement of said actuator;

wherein said actuator has a central portion with an opening extending longitudinally therethrough for accommodating means to illuminate said switch; and wherein said illumination means comprise a lamp base mounted at said other end of said housing between opposed pairs of said peripheral stationary contacts and a lamp mounted to said base and extending longitudinally into said housing through said opening in said actuator.

6. The switch according to claim 5 wherein an outer portion of said opening has a parabolic configuration for enhancing illumination.

7. The switch according to claim 5 further comprising display means mounted to the outer end of said actuator.

8. The switch according to claim 7 wherein said display means comprises a shell-like button cap removably mounted to the outer end of said actuator.

9. The switch according to claim 8 wherein said display means further comprises a color filter removably mounted to said button cap and situate between said actuator and said button cap in assembled condition.

10. The switch according to claim 9 wherein said display means further comprises a film legend insert retained between said button cap and said filter.

11. The switch according to claim 5 wherein said biasing means comprises a helical compression spring encircling said central portion.

12. The switch according to claim 5 having up to six poles and housed in a square housing having a width not greater than about three-quarters of an inch.

13. An electric switch comprising:

an elongated housing;

an insulating actuator received at one end of said housing for limited linearly reciprocal movement longitudinally therein and having a plurality of legs in lateral peripheral arrangement thereon and extending longitudinally into said housing;

means biasing said actuator outwardly of said housing;

a plurality of movable contact members, each carried by a respective leg; and a plurality of pairs of laterally spaced stationary leaf spring contacts mounted at the other end of said housing in lateral peripheral arrangement and extending longitudinally into said housing, each pair being slidingly bridged by a respective contact member driven therebetween by a respective leg in responsive to movement of said actuator; and further comprising alternate action means mounted at said other end of said housing between opposed pairs of said peripheral stationary contacts and extending longitudinally into said housing to cooperate with actuator to afford push-push operation thereof.

14. The switch according to claim 13 wherein said alternate action means comprises a base mounted at said other end of said housing, detent cam means in at least one longitudinal side of said base forming a series of channelled ramps and dropoff shoulders, and wire means hooked at one end to said actuator and riding in said detent cam means at the other end.

15. The switch according to claim 14 wherein said base has two detent cam means formed in opposed longitudinal sides thereof, and wherein said wire means comprise two elongated C-shaped wire members.

16. An electric switch comprising:

an elongated housing;

an insulating actuator received at one end of said housing for limited linearly reciprocal movement longitudinally therein and having a plurality of legs in lateral peripheral arrangement thereon and extending longitudinally into said housing;

means biasing said actuator outwardly of said housing;

a plurality of movable contact members, each carried by a respective leg; and a plurality of pairs of laterally spaced stationary leaf spring contacts mounted at the other end of said housing in lateral peripheral arrangement and extending longitudinally into said housing, each pair being slidingly bridged by a respective contact member driven therebetween by a respective leg in response to movement of said actuator; and further comprising wire means hooked at one end to said actuator, a base mounted at said other end of said housing between opposed pairs of said stationary contacts, and detent means formed in said base and engaged by the other end of said wire means to provide audible or tactile feedback to operation of said actuator.

17. An electric switch comprising:

an elongated housing;

an insulating actuator received at one end of said housing for limited linearly reciprocal movement longitudinally therein and having a plurality of legs in lateral peripheral arrangement thereon and extending longitudinally into said housing;

means biasing said actuator outwardly of said housing;

a plurality of movable contact members, each carried by a respective leg; and a plurality of pairs of laterally spaced stationary leaf spring contacts mounted at the other end of said housing in lateral peripheral arrangement and extending longitudinally into said housing, each pair being slidingly bridged by a respective contact member driven therebetween by a respective leg in response to movement of said actuator; and further comprising a combination lamp and alternate action cam base mounted at said other end of said housing between opposed pairs of said peripheral stationary contacts, a lamp mounted to said base and extending longitudinally through a central opening in said actuator, and wire means hooked at one end to said actuator and riding at the other end in a series of channelled ramps and drop-off ledges formed in said base.

* * * * *